United States Patent [19]

Marsing

[11] Patent Number: 4,808,941

[45] Date of Patent: Feb. 28, 1989

[54] SYNCHROTRON WITH RADIATION ABSORBER

[75] Inventor: Helmut Marsing, Neunkirchen, Fed. Rep. of Germany

[73] Assignee: Siemens Aktiengesellschaft, Munich, Fed. Rep. of Germany

[21] Appl. No.: 108,486

[22] Filed: Oct. 14, 1987

[30] Foreign Application Priority Data

Oct. 29, 1986 [DE] Fed. Rep. of Germany ..... 3636841

[51] Int. Cl.[4] ..... H05H 13/02

[52] U.S. Cl. ..... 328/235; 328/228

[58] Field of Search ..... 328/228, 233, 235

[56] References Cited

U.S. PATENT DOCUMENTS 4,641,057 3/1987 Blosser et al. ..... 328/235 X

FOREIGN PATENT DOCUMENTS 3530446 3/1986 Fed. Rep. of Germany .

*Primary Examiner*—David K. Moore
*Assistant Examiner*—K. Wieder
*Attorney, Agent, or Firm*—Kenyon & Kenyon

[57] ABSTRACT

For accelerating charged particles, an acceleration path in the form of a race track is provided with straight track sections and curved track sections with which dipole magnets with curved flat coils are associated and which are provided radially outward with at least one exit opening for synchrotron radiation. According to the invention, an absorber (20) is arranged in the chambers (16) of the curved track sections (3, 4) and a support structure (60) is provided between the dipole magnets (22, 23) behind the absorber (20) in the direction of the synchrotron radiation (18). The absorber (20) can advantageously be provided with additional cooling. The support structure serves as a spacer for the superconducting dipole magnets (22, 23) of the curved track sections (3, 4). The support structure for the flat coils is thereby simplified accordingly.

3 Claims, 3 Drawing Sheets

SYNCHROTRON WITH RADIATION ABSORBER

BACKGROUND AND SUMMARY OF THE INVENTION

The invention is directed to a synchrotron for accelerating charged particles on a trajectory including straight portions, with which means for electron injection and acceleration as well as focusing are associated. The trajectory further contains curved portions with which superconducting curved flat coils are associated, which coils are arranged in a cryogenic vessel. In the curved portions, the trajectory is surrounded by chambers which are provided radially outwardly with at last one exit opening for synchrotron radiation.

As is well known, electrons and protons can be accelerated in a synchrotron to high energies by the provision that they are set in rotation on a curved trajectory and are repeatedly conducted through a high-frequency acceleration cavity. The particle always passes through the acceleration section if the applied a-c voltage has the sign which is correct for acceleration; the particle therefore revolves synchronously with the a-c voltage, i.e., with the correct phase. In an electron synchrotron, the electrons are introduced into the acceleration section already approximately at the speed of light; with the frequency of rotation being fixed, and only the electron energy remaining variable. The synchrotron radiation, i.e., the relativistic radiation emission of the electrons, which revolve approximately with the speed of light and are kept on a circular track by deflection in a magnetic field of superconducting coils, furnishes X-radiation with parallel radiation characteristics and high intensity. As is well known, this synchrotron radiation can be used for X-ray lithography which is suitable in the manufacture of integrated circuits, i.e. for generating structures which are smaller than 0.5 $\mu$m. The parallel X-radiation strikes a mask to be imaged in the usable wavelength range of about $\lambda=0.2$ to 2 nm. The semiconductor wafer to be exposed is arranged behind the mask at a suitable proximity spacing.

One known embodiment of an electron synchrotron contains a track in the form of a race track with alternatingly straight and curved track sections. The radius of curvature of the curved track sections is obtained by the equilibrium between the centrifugal force and the Lorentz force of a magnetic field of dipole magnets which are designed as superconducting curved flat coils. These field coils are arranged with a gradient coil in a cryogenic vessel which also keeps the evacuated chamber in the curved track section in which the electrons are circulated, at the cryogenic temperature. With the straight sections of the acceleration path are associated an electron injector, with which the electrons are introduced into the acceleration path, as well as means for accelerating the electrons (See, e.g., German Offenlegungsschrift No. 35 30 446).

In the above-described design for a synchrotron, the chamber is always provided with a slot-shaped exit opening extending along the entire curved track section of the track always. The Lorentz forces of the superconducting flat coils must therefore be taken up by the legs of a C-shaped section of a U-shaped support structure. Since a change in position of the flat coils under the action of the Lorentz forces must be avoided to prevent a corresponding field distortion, a correspondingly elaborate support structure is necessary.

It is therefore an object of the invention to simplify and improve the support structure for the field coils of the dipole magnets in the curved region of the track; and in particular, to provide a simplified structure to prevent bending stresses in the legs of the C-shaped sections.

According to the invention, the object is achieved by providing an absorber in each of the chambers surrounding the electron trajectory. The absorber leaves free for the synchrotron radiation at least one and optionally several exit openings which are preferably designed as exit tubes. The space between these tubes in the direction of the tangentially conducted-off synchrotron radiation behind the absorber can now be filled with a support structure, for example, support elements preferably comprising fiber glass-reinforced plastic GFK. By virtue of the support structure, which in practice acts only as a simple spacer, large magnetic forces of the superconducting coils can be taken up such that a special support structure is no longer required.

To limit the heating of the walls of the electron beam chamber, which is kept at cryogenic temperatures, as well as to reduce the desorption of particles of the material of the absorber, it is advisable to provide additional cooling for the absorber.

For a further explanation of the invention, reference should be made to the following detailed description and the accompanying drawings, in which an exemplary embodiment of a synchrotron according to the invention is illustrated schematically.

DETAILED DESCRIPTION

Figure 1:
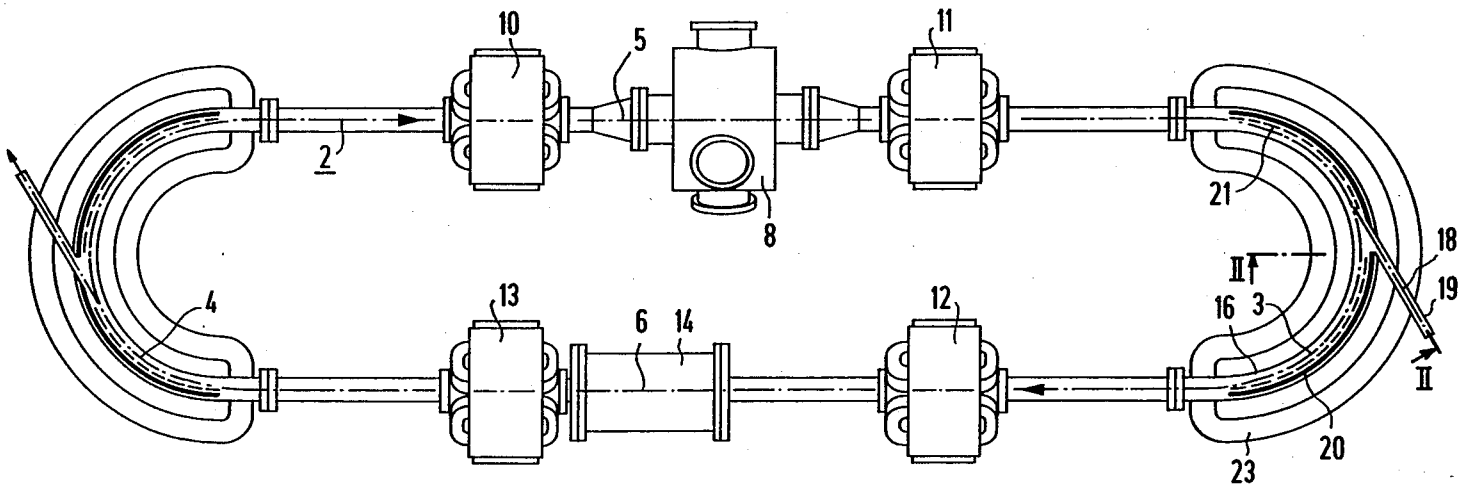
FIG. 1 illustrates a top view of a synchrotron.

In the schematic overview of an electron synchrotron according to FIG. 1, an electron trajectory or track 2 consists of curved track sections 3 and 4 as well as straight track sections 5 and 6. The track section 5 contains a cavity resonator 8 with a frequency of, for instance, 500 MHz for electron acceleration and two quadrupole magnets 10 and 11, of which one serves for focusing and the other for defocusing. The other straight track section 6 is likewise provided with two quadrupole magnets 12 and 13, of which one serves for focusing and the other for refocusing, as well as with an injection device 14 for electrons.

The curved sections 3 and 4 are of similar design and are therefore provided with the same reference symbols. The two curved track sections are shown schematically in cross section. The evacuated chambers 16, each surrounding one of the curved track sections 3 and 4, are slightly enlarged outwardly and contain, in the direction of the synchrotron radiation 18, an absorber 20. Each of the absorbers may optionally be preceded by a slot aperture 21. For conducting the synchrotron radiation 18 out of each of the chambers 16, a drill hole is provided in the absorber 20 which communicates with a radiation tube 19. For deflecting the electrons in the curved track sections 3 and 4 several superconducting dipole magnets are provided each comprising superconducting curved flat coils. Only one dipole magnet is illustrated in FIG. 1 and is designated by the reference numeral 23. Associated with the dipole magnets are gradient coils and correction coils which, for simplification, are not shown in the figure.

Figure 2:
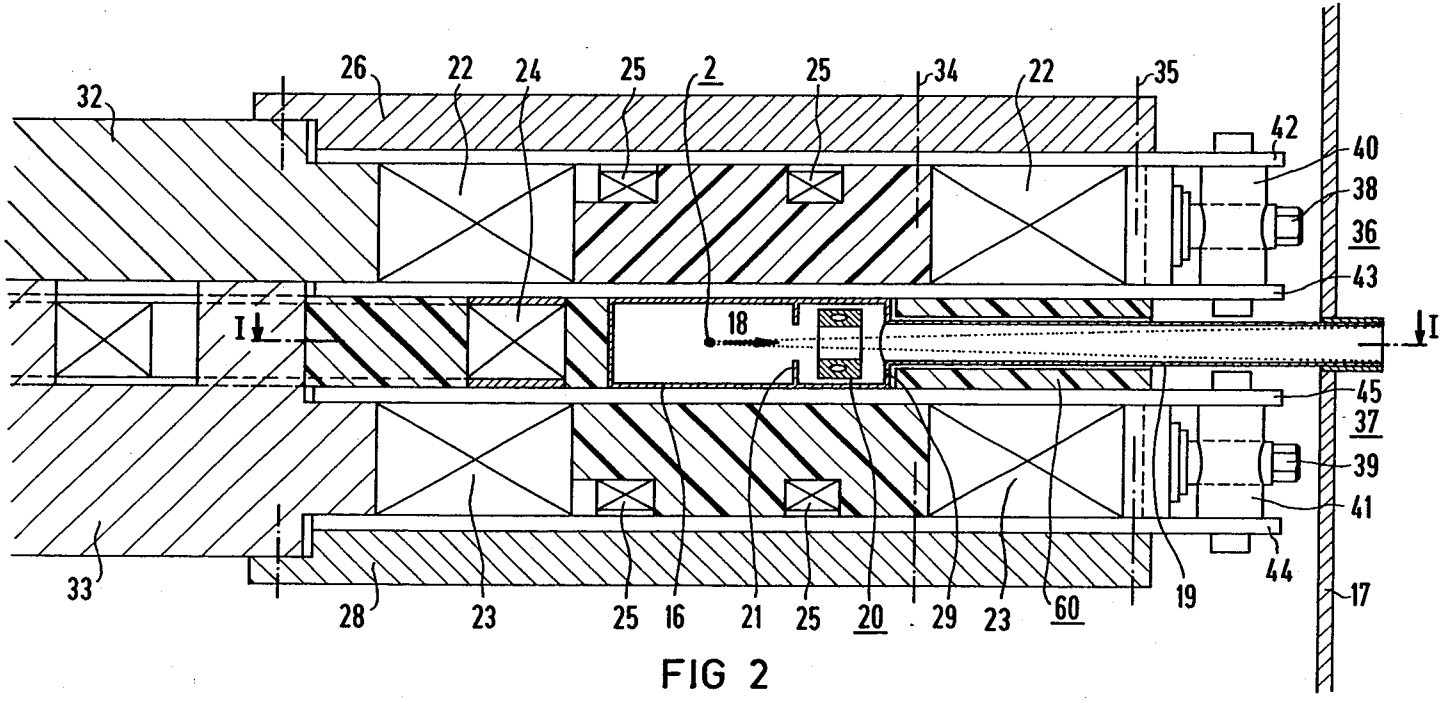
FIG. 2 illustrates a cross-section through one of the curved sections of the electron trajectory of the synchrotron according to FIG. 1.

In the embodiment according to FIG. 2, the group of dipole magnets 22 are arranged above the chamber 16 and of which, as indicated above, only one is illustrated in the figure for purposes of simplification. Moreover, a group of dipole magnets 23 is arranged below the chamber 16 about the curved track section 3 of the track 2. The chamber 16 surrounds the curved track section of the electron trajectory 2 and is provided with the radiation tube 19 for conducting off the synchrotron radiation 18. The radiation tube 19 is brought through the wall of a helium vessel 17 in a high-vacuum-tight manner. With the curved track section 3 of the electron track 2 are further associated correction coils 25 and a gradient coil 24. Above and below the groups of dipole magnets 22 and 23, covering devices 26 and 28, respectively, are provided which, in the case of a design utilizing plastic, can be made as cover plates and in the case of a metal design, as cover ribs. The cover device 26 is detachably connected to an upper support structure 32 and the lower cover device 28 to a lower support structure 33.

For taking up the forces of the groups of dipole magnets 22 and 23 in the vertical direction, simple through screw connections 34 and 35 are provided which are indicated only schematically in the figure. To take up the Lorentz forces in the radial direction, mountings 36, 37 are provided for the groups of dipole magnets 22 and 23, each of which substantially comprises a threaded bolt 38, 39 and a support bolt 40, 41, which are supported in two tie rods 42, 43 and 44, 45, respectively. The tie rods 42 and 43 are fastened to the support structure 32, and the tie rods 44 and 45 are fastened to the lower support structure 33.

The curved track section 3 of the electron track 2 is surrounded by the chamber 16, which is provided with at least one exit opening for the synchrotron radiation 18. Advantageously, a common absorber 20 may be provided for the entire curved track region 3, which is preceded by the slot aperture 21 and the curvature of which is fitted to the shape of the electron track 2 in the region 3. The absorber 20 is merely provided with a corresponding opening for the synchrotron radiation 18.

For the absorber 20, liquid cooling may preferably be provided, the cooling medium of which flows through cooling canals 51 and 52 (see FIG. 4), which are in communication with a coolant reservoir not shown in the figure and for which recirculation cooling is provided. The absorber 20 protects an outer wall 29 of the electron beam chamber 16, which is arranged behind the absorber 20 in the direction of the synchrotron radiation 18. A support structure 60 acts, in a simple manner, merely as filling material for the space between the radially outer part of the turns of the dipole magnet 22 and the corresponding part of the turns of the dipole magnet 23. This support structure 60 can advantageously consist of fiber glass-reinforced plastic and can be fixed in its position by the pressure forces of the screw connections 34 and 35 alone. The support structure 60 may consist, however, also of individual support elements or spacers, not shown in the figure.

Figure 3:
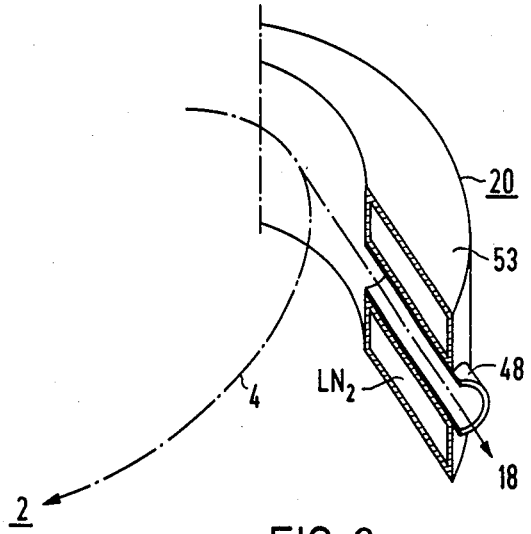
FIGS. 3 and 4 illustrate cross-sections through an absorber with one exit aperture according to the invention.

In the embodiment according to FIG. 2, the absorber 20 consists of a curved metallic housing 53 (see FIG. 3), for instance, of stainless steel, the curvature of which is fitted to the electron track 2 in the curved track section 3, and of which the housing wall facing the electron track always has the same spacing from this track. Through the absorber 20 flows a coolant, preferably liquid nitrogen $LN_2$. In a corresponding opening of the housing 53, a beam passage tube 48 is arranged in such a manner that the synchrotron radiation 18, which is radiated-off tangentially in the track section 3 and is indicated dashed-dotted in FIG. 3, can pass through the absorober 20. The passage tube 48 is connected undetachably to the housing 53 of the absorber 20 and is preferably welded thereto in a high vacuum-tight manner.

Figure 4:
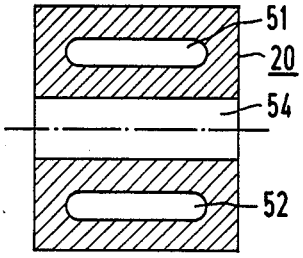

In a particularly simple embodiment according to Fig. 4, the absorber 20 consists, for instance, of a metal section, preferably of copper or brass, with cooling canals 51 and 52, which section is provided with an opening 54 for conducting the synchrotron beam through.

What is claimed is:

1. In a synchrotron for accelerating charged particles on a trajectory, which synchrotron comprises:
   (a) straight track portions including associated means for particle injection and acceleration;
   (b) curved track sections including superconducting, vertically spaced, curved dipole magnets arranged in a cryogenic vessel about said trajectory, and;
   (c) the trajectory of said curved track sections being surrounded by a chamber including at least one exit opening for tangential radiation emission, an improvement wherein:
   (d) an absorber is arranged in each of said chambers of the curved track sections and conformed about the outer most curved portion of said trajectory;
   (e) said absorber including at least one exit opening for passage of said tangential radiation emission;
   (f) each of said chambers being provided with at least one radiation tube for said tangential radiation emission, which radiation is emitted through said exit opening of said absorber; and
   (g) in each of said chambers, respective support structures being provided behind said absorber and in the vertical space between said dipole magnets to maintain the vertical spacing therebetween.

2. The synchrotron of claim 1 and further a cooling means being provided for each of said absorbers.

3. The synchrotron of claim 2, wherein said cooling means utilizes liquid nitrogen.

* * * * *